US010874935B1

(12) United States Patent
Shaw

(10) Patent No.: US 10,874,935 B1
(45) Date of Patent: Dec. 29, 2020

(54) CHESS SYSTEM AND METHOD OF USE

(71) Applicant: Jesse R. Shaw, Watertown, MA (US)

(72) Inventor: Jesse R. Shaw, Watertown, MA (US)

( * ) Notice: Subject to any disclaimer, the term of this patent is extended or adjusted under 35 U.S.C. 154(b) by 0 days.

(21) Appl. No.: 16/423,872

(22) Filed: May 28, 2019

Related U.S. Application Data

(60) Provisional application No. 62/676,733, filed on May 25, 2018.

(51) Int. Cl.
*A63F 3/02* (2006.01)
*A63F 3/00* (2006.01)

(52) U.S. Cl.
CPC ..... *A63F 3/02* (2013.01); *A63F 3/00697* (2013.01); *A63F 3/022* (2013.01); *A63F 3/027* (2013.01); *A63F 2003/007* (2013.01); *A63F 2003/0088* (2013.01); *A63F 2003/00646* (2013.01); *A63F 2003/00649* (2013.01); *A63F 2003/00656* (2013.01); *A63F 2003/00659* (2013.01); *A63F 2003/00858* (2013.01); *A63F 2003/00867* (2013.01); *A63F 2003/025* (2013.01)

(58) Field of Classification Search
CPC .. A63F 3/02; A63F 3/022; A63F 3/027; A63F 2003/025; A63F 2003/00652; A63F 2003/00646; A63F 2003/0649; A63F 2003/00656; A63F 2003/00659; A63F 2003/00867; A63F 2003/0088; A63F 2003/00883
USPC ..... 273/260, 261, 288
See application file for complete search history.

(56) References Cited

U.S. PATENT DOCUMENTS 1,628,412 A * 5/1927 Lesavoy ..... A63F 3/00697 273/288
3,608,904 A * 9/1971 Margetson ..... A63F 3/00697 273/288
4,093,237 A * 6/1978 Weiss ..... A63F 3/00895 273/260
5,011,159 A * 4/1991 Fortunato ..... A63F 3/02 273/260
5,197,741 A * 3/1993 Wu ..... A63F 3/00697 273/237
2009/0020949 A1* 1/2009 Arias, III ..... A63F 1/04 273/260
2009/0322026 A1* 12/2009 Sun ..... A63F 3/02 273/238

(Continued)

OTHER PUBLICATIONS

Bodlanender, Hans and Storz, Matt, "Diagonal Quadrant Chess", Nov. 3, 1998, http://www.chessvariants.com/diffsetstup.dir/diagonalquadrant.html (Year: 1998).*

(Continued)

*Primary Examiner* — Benjamin Layno
(74) *Attorney, Agent, or Firm* — Richard Eldredge; Eldredge Law Firm

(57) ABSTRACT

A chess game method includes providing a standard chess board having squares of alternating colors; providing a first set of chess pieces of a first color and a second set of chess pieces of a second color; arranging the first set of chess pieces in a first corner of the standard chess board such that a king of the first set of chess pieces is in the corner; and arranging the second set of chess pieces in the second corner of the standard chess board such that a king of the second set of chess pieces is in the second corner; the first corner is directly opposite the second corner.

3 Claims, 9 Drawing Sheets

(56) References Cited

U.S. PATENT DOCUMENTS

2011/0049804 A1* 3/2011 Lockyear ..... A63F 3/02
273/260

OTHER PUBLICATIONS

Kostas Aka The Dog, "snapshots for the world's very first(?) DIAGONAL CHESS single game tournament", Oct. 24, 2008, http://kostasandchrysa.blogspot.com/2008/10/snapshots-for-worlds-very-first.html. (Year: 2008).*

* cited by examiner

701

King-A1
Queen-B2
First Bishop-A2
Second Bishop-B1
First Knight-A3
Second Knight-C1
First Rook-A4
Second Rook-D1
First Pawn-A5
Second Pawn-B4
Third Pawn-B3
Fourth Pawn-C3
Fifth Pawn-C2
Sixth Pawn-D2
Seventh Pawn-E1
Eight Pawn-D4

CHESS SYSTEM AND METHOD OF USE

BACKGROUND

1. Field of the Invention

The present invention relates generally to chess game systems and methods, and more specifically, to a chess game and system that utilizes conventional chess boards and chess pieces in a new and novel way.

2. Description of Related Art

Chess game systems are well known in the art and are effective means of entertainment and competition. For example, FIG. 1 depicts a conventional chess game system 101 having a board 103 with alternating checkered squares and having a first set of chess pieces 105 and a second set of chess pieces 107 arrange opposite one another. During use, the players will alternate taking turns and moving their pieces as according to rules and instructions.

One of the problems commonly associated with system 101 is limited use. For example, there are limited numbers of ways for players to engage in the game, and therefore, the playing of chess can become repetitive and mundane.

Accordingly, although great strides have been made in the area of chess game systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
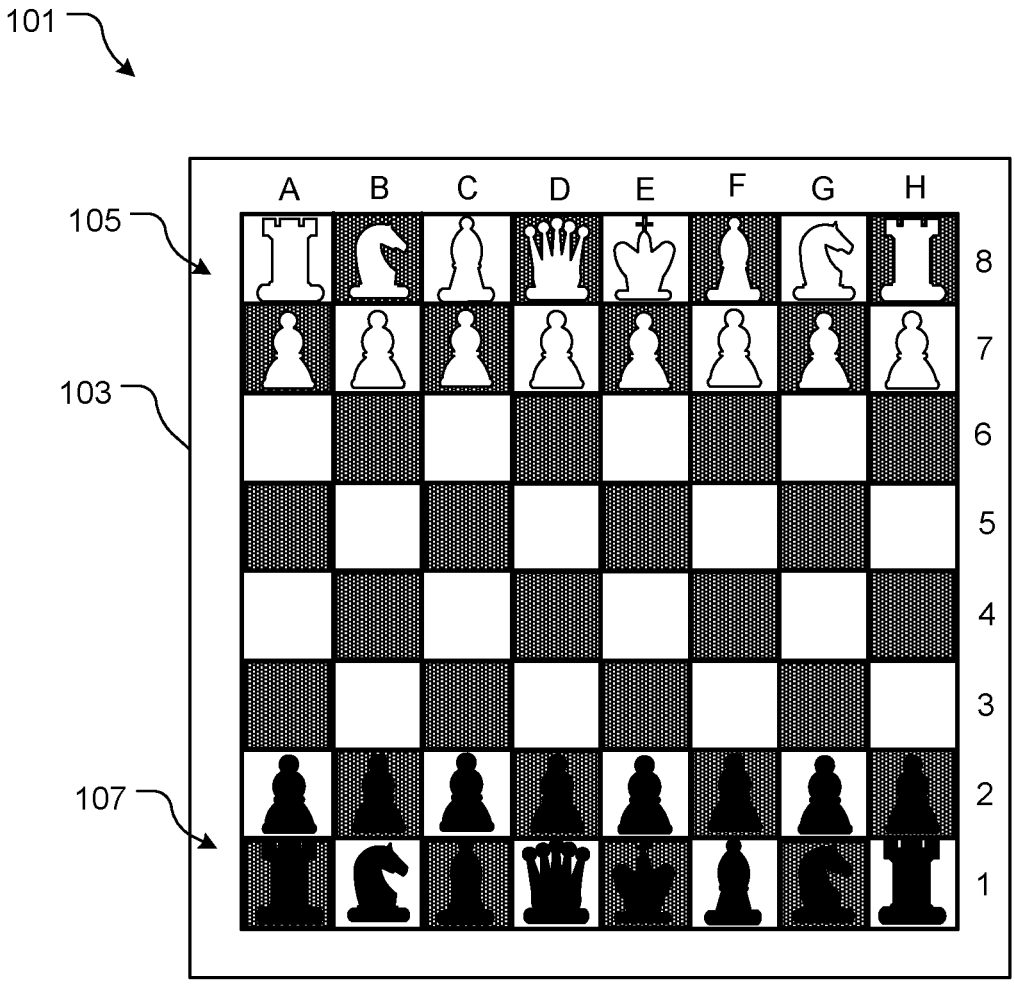
FIG. 1 (Prior Art)
FIG. 1 depicts a top view of a conventional chess game system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
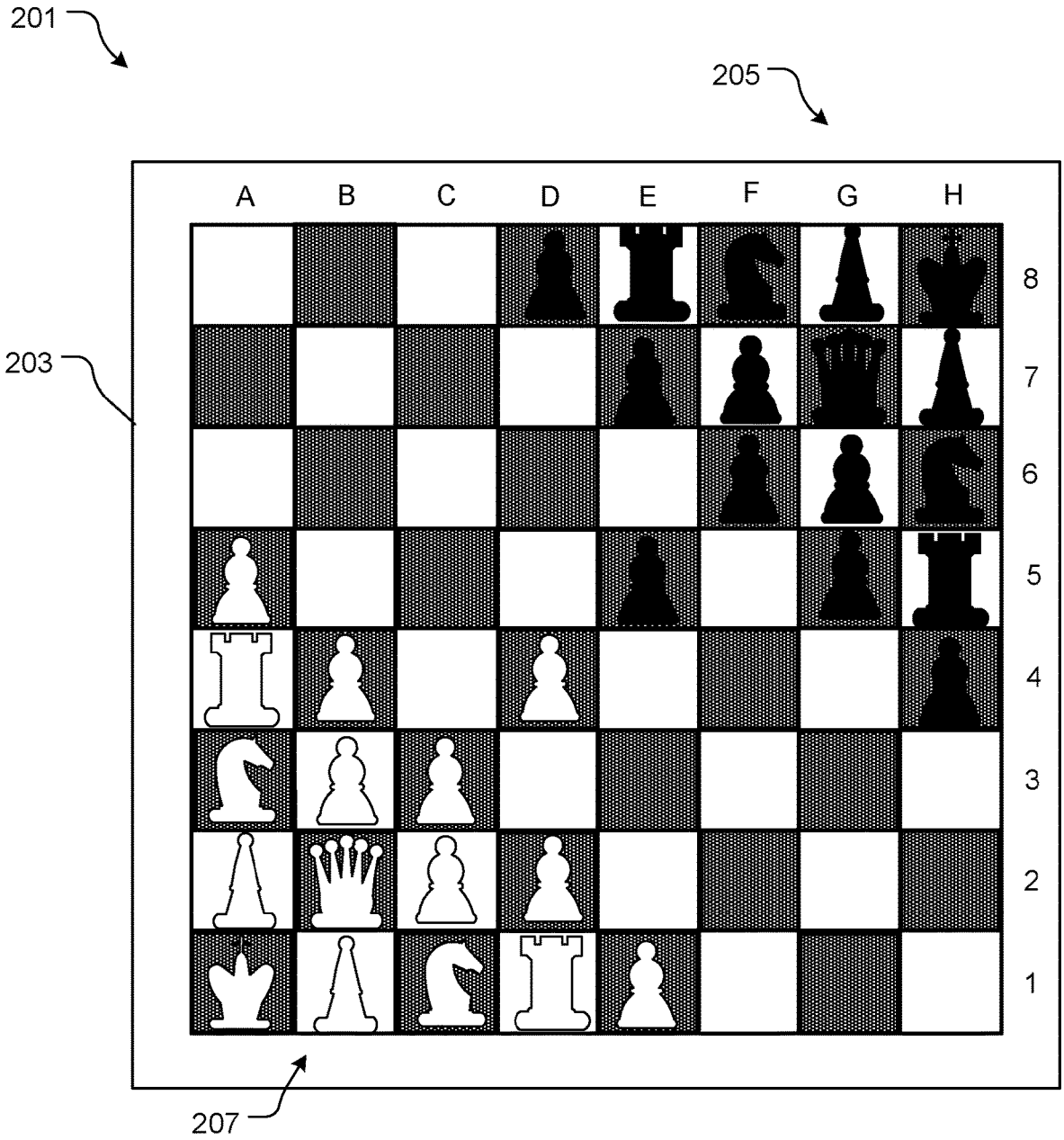
FIG. 2 is a top view of a chess game system in accordance with a preferred embodiment of the present application.

Referring now to the drawings wherein like reference characters identify corresponding or similar elements throughout the several views, FIG. 2 depicts a top view of a chess game system 201 in accordance with a preferred embodiment of the present application. It should be appreciated that system 201 provides for a new and novel means of playing a game of chess with a conventional board and chess pieces.

In the contemplated embodiment, the system 201 includes a standard chess board 203 that includes an alternating checkered colored pattern, as is known in the art. The system 201 further comprises a first set of chess pieces 205 and a second set of chess pieces 207, the first and second set being of different colors. It should be appreciated that the system can be incorporated into a physical chess game, or an electronic or digital chess game, wherein the functionality and method of playing is the same.

As shown, the system includes an arrangement of the first and second set of chess pieces 205, 207 at 45 degree angles, wherein the sets are arranged at the corners of the chess board.

Figures 6, 7:
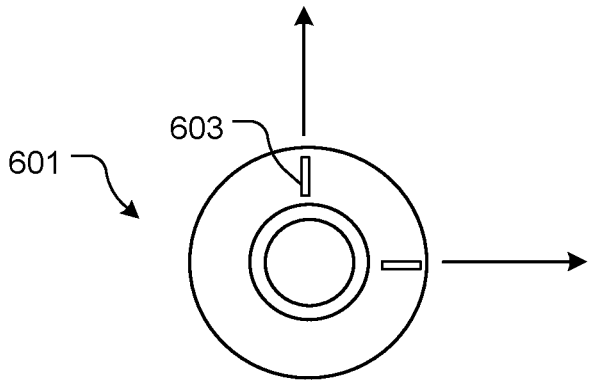
FIG. 6 is a top simplified schematic of a pawn in accordance with the present invention.
FIG. 7 is a chart depicting the initial arrangement of the first set of chess pieces in accordance with the present application.

As shown, the first and second sets of chess pieces include conventional chess pieces, namely a king, a queen, two rooks, two bishops, two knights, and eight pawns. In FIG. 7, the arrangement 701 of a first set of chess pieces is shown, wherein the pieces are arranged with the kind in the corner. As shown, the positioning for the start of the game includes the following: King—A1; Queen—B2; First Bishop—A2; Second Bishop—B1; First Knight—A3; Second Knight—C1; First Rook—A4; Second Rook—D1; First Pawn—A5;

Second Pawn—B4; Third Pawn—B3; Fourth Pawn—C3; Fifth Pawn—C2; Sixth; Pawn—D2; Seventh Pawn—E1; Eight Pawn—D4.

Figure 3A:
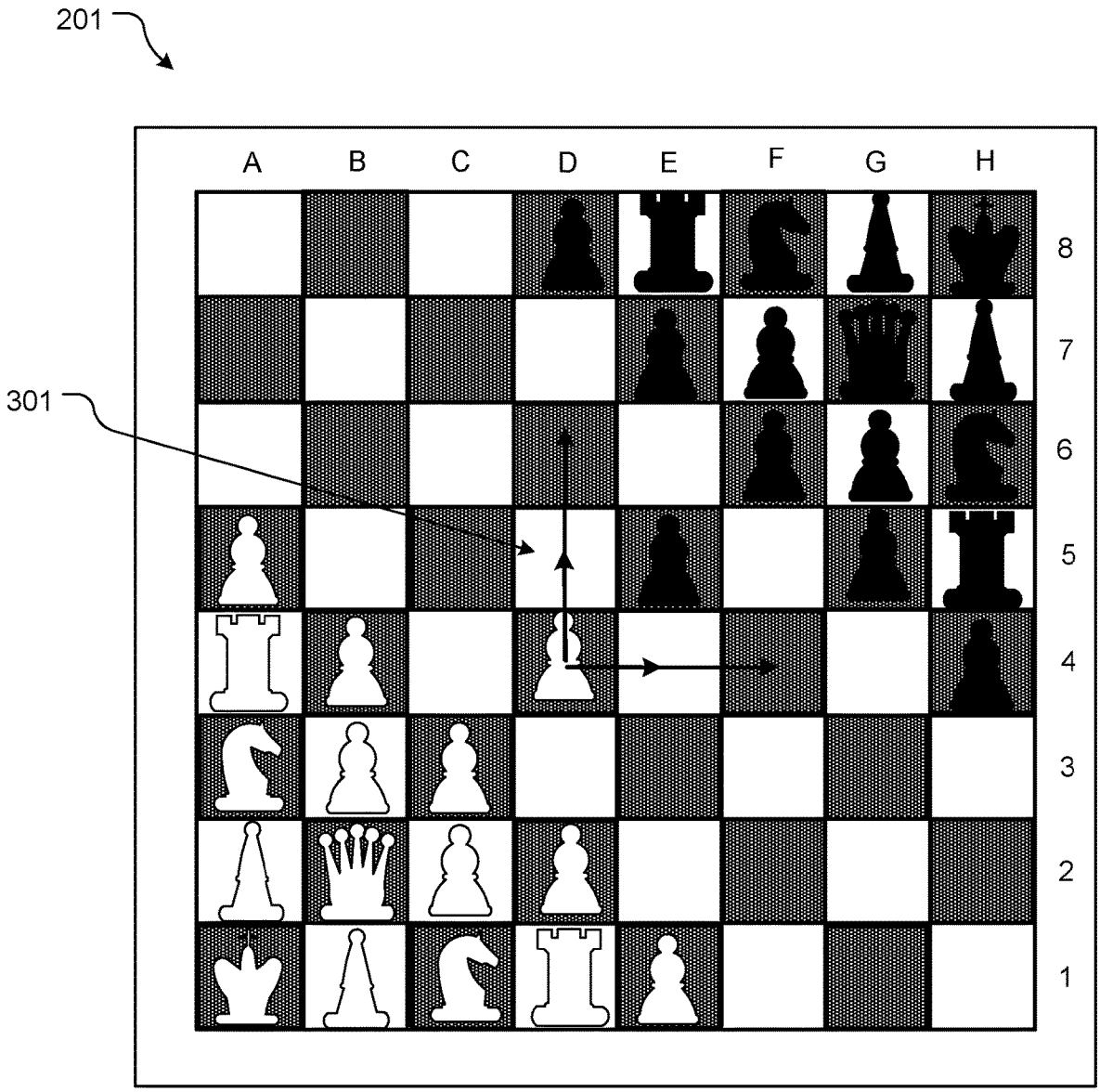
FIGS. 3A and 3B are top views of the system of FIG. 2 depicting the first move options for a pawn.
Figure 3B:
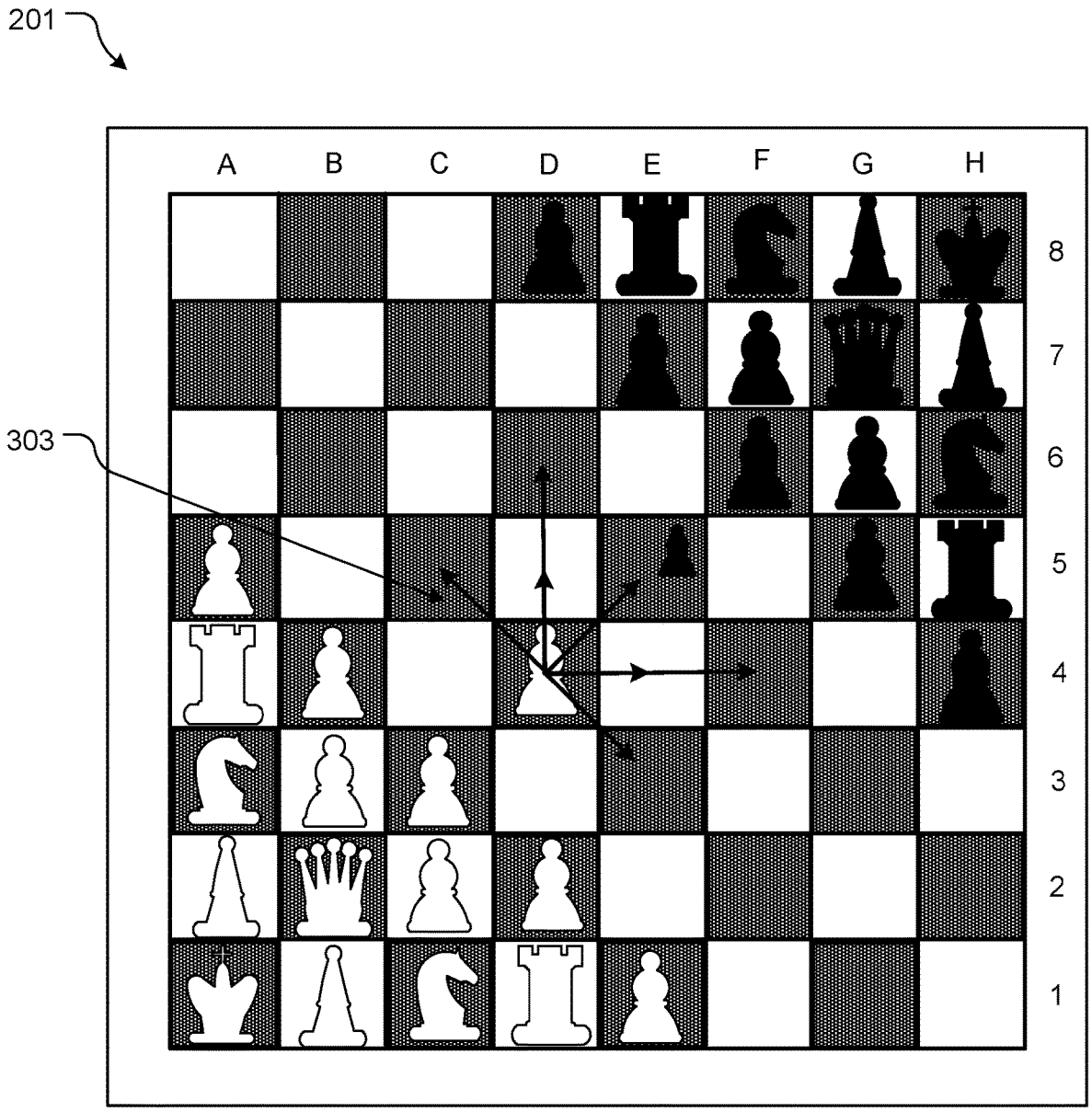

The rules of the present system and method are similar to the rules of conventional chess, with the exception of the pawns. As shown in FIGS. 3A and 3B, the pawn can either choose a direction of promotion and move one or two spots, shown with arrows 301, or alternatively, can use an attach move, shown with arrow 303. It should be appreciated that there must be a component piece to attack in the appropriate square.

It should be appreciated that instead of conventional pawn moves, wherein the pawns can take an initial move of 1 to 2 spaces North or South (depending on the player), the pawns of the system and method of the present invention have the ability to move multi-dimensionally.

Figure 4A:
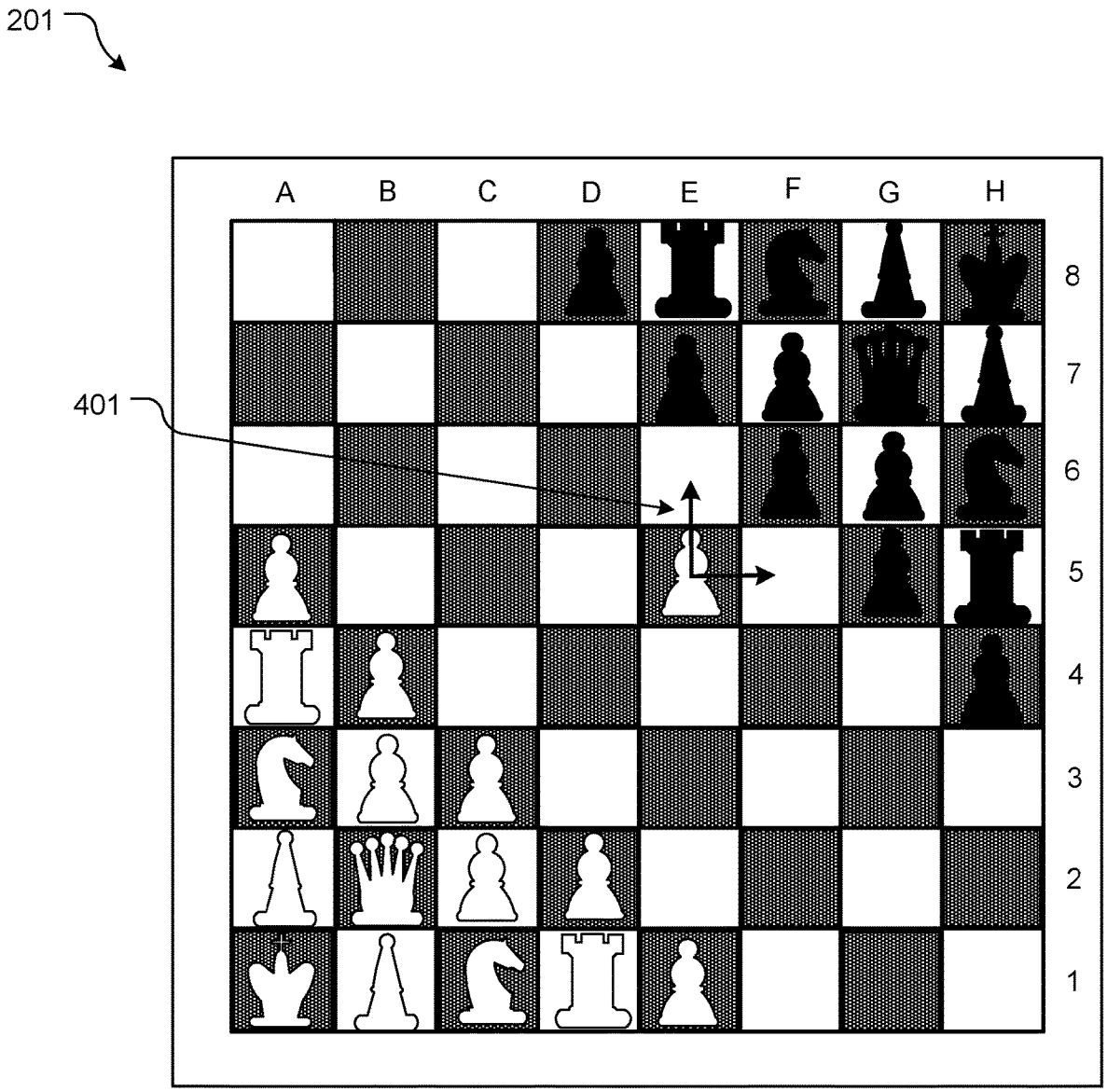
FIGS. 4A and 4B are top views of the system of FIG. 2 depicting promotion moves for a pawn after a first move of attack and second attack moves available to the pawn after attack.
Figure 4B:
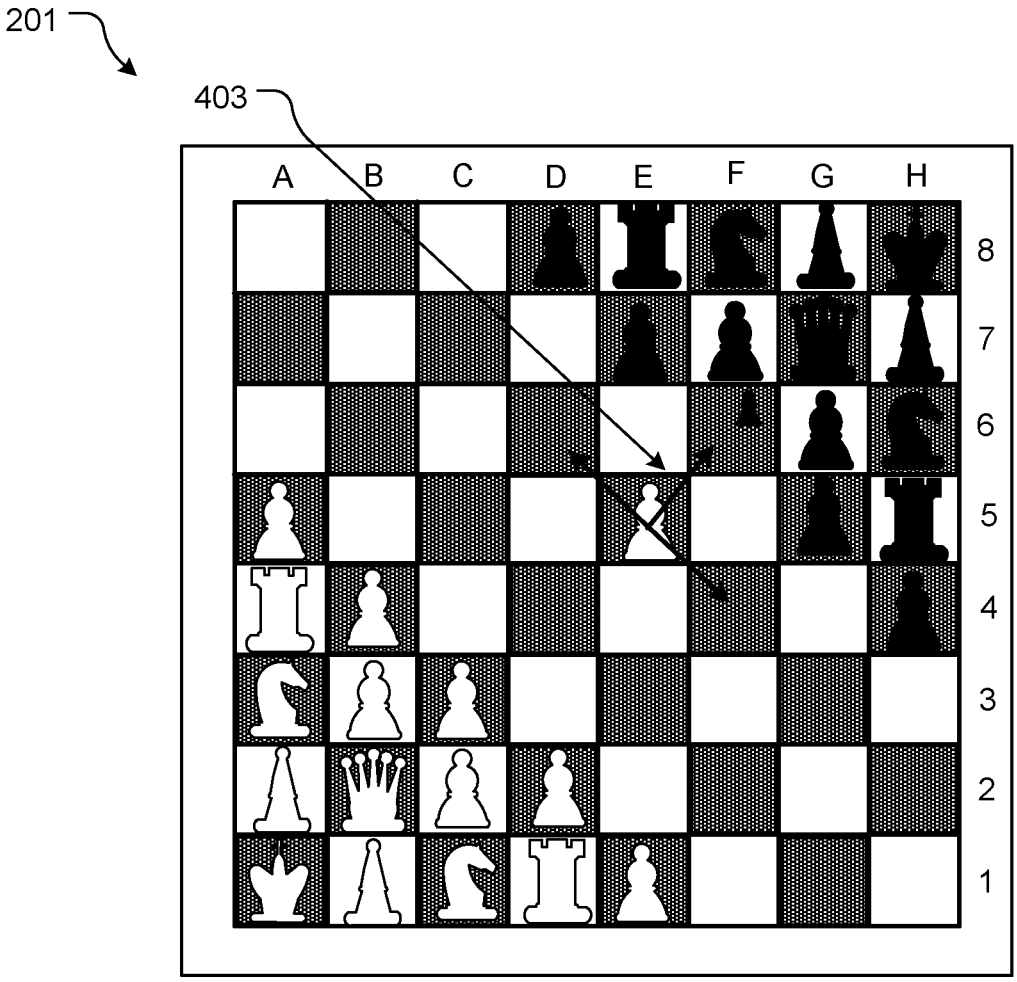

As shown in FIGS. 4A and 4B, should the pawns first move to be an attack, as shown, the pawn can still choose a direction of promotion, shown with arrow 401. Additionally, after the first move of attack, the pawn could also attack again, as shown with arrow 403.

It should be appreciated that once a pawn decides on a direction towards promotion, it must move in that direction, however, a direction is not chosen if the first move is an attack. If the pawn captures an opposing piece before choosing a direction, it is still eligible to pick a direction, as it has not designated a direction toward promotion. However, the pawn is therefore no longer allowed to move 2 spaces for its initial move.

Figure 5A:
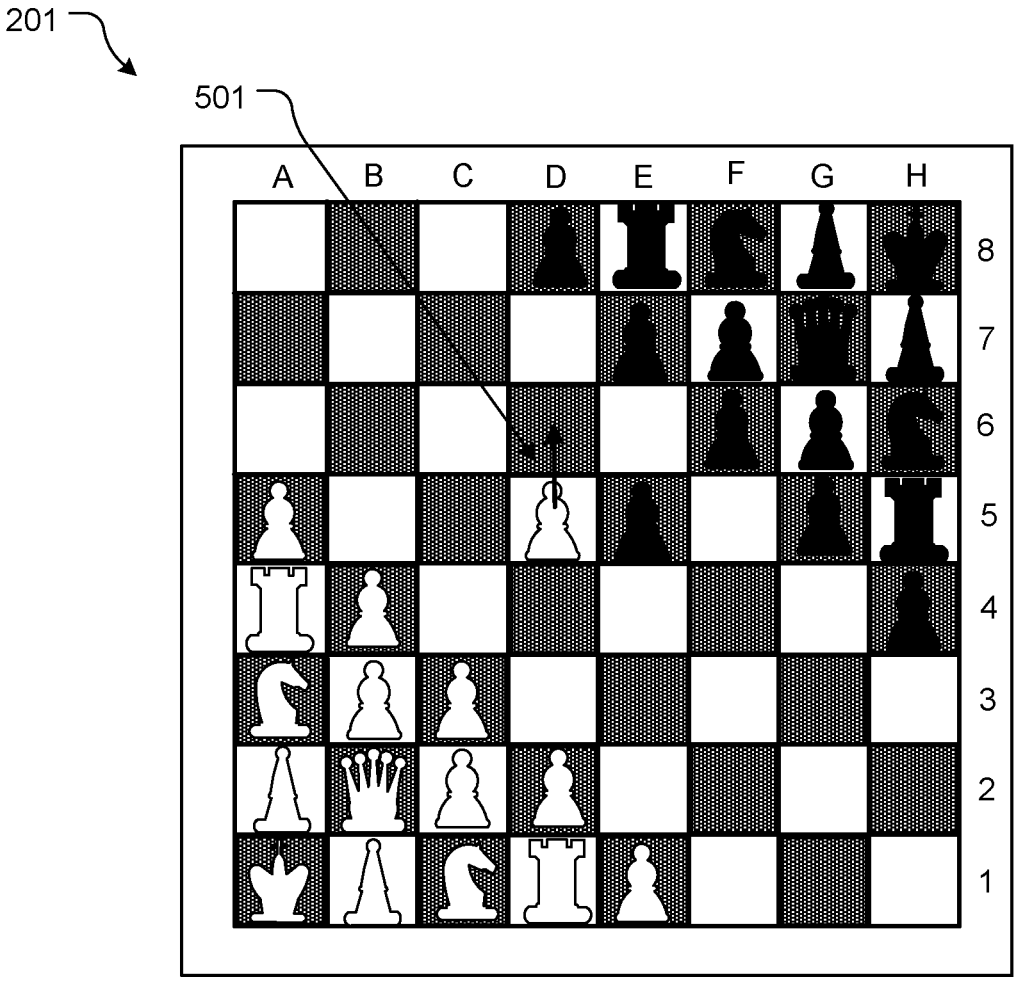
FIGS. 5A and 5B are top views of the system of FIG. 2 depicting a second move of a pawn after a direction is chosen and also attack moves of the pawn after the direction is chosen.
Figure 5B:
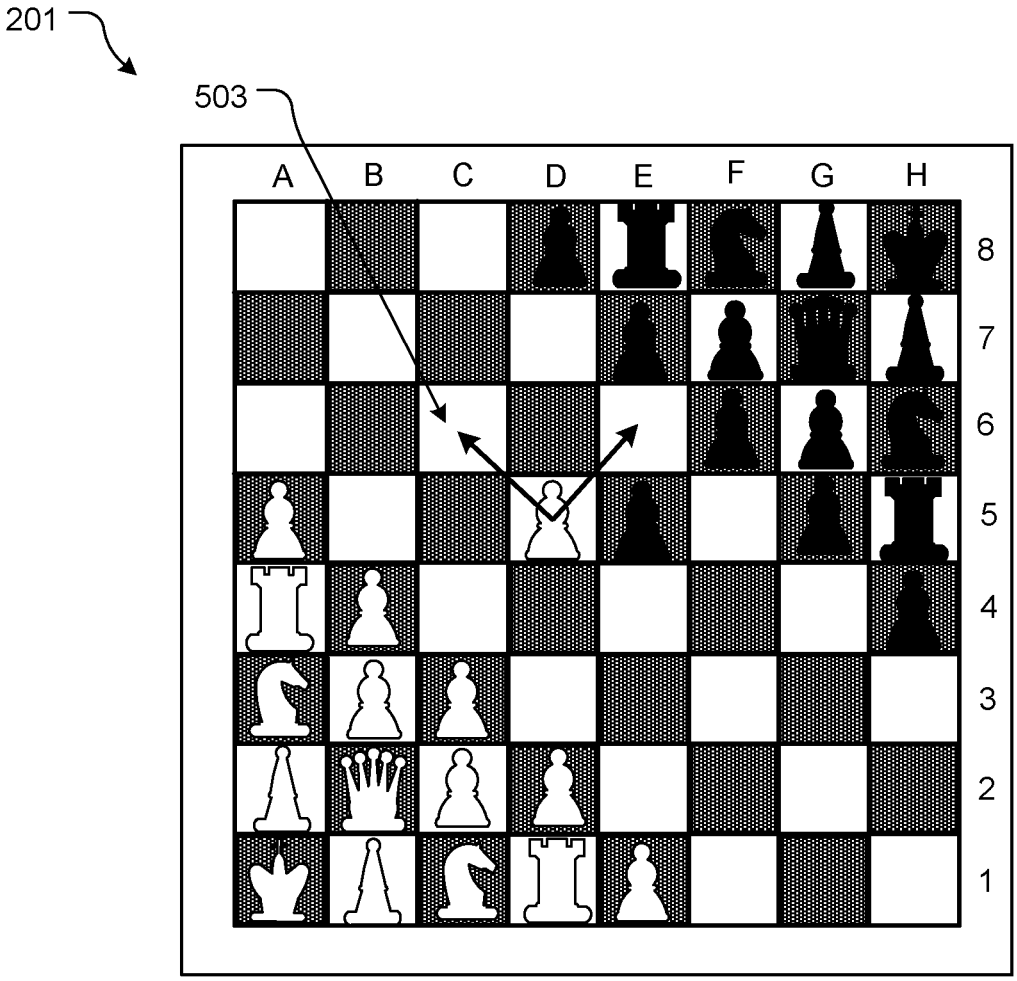

In FIGS. 5A and 5B, the pawn options are shown assuming the pawn has selected a direction in the first move. The pawn can then continue in the same direction, shown with arrow 501, or alternatively, can attack shown with arrow 503 in the direction of choice.

One of the unique features believed characteristic of the present application is the arrangement and movement of the pawns, thereby allowing for additional decision making during chess. It must be understood that the system and method of the present invention can be adapted for physical chess playing, or electronic chess playing.

As with standard chess, the system and method of the present invention allows for pawns to capture opposing pieces diagonally. Should a pawn capture an opposing piece, the pawn must do so in the forward direction. A pawn cannot capture an opposing piece if that action requires the pawn to land in a backward square.

It should be appreciated that in the preferred method of use, the board is arranged at 45 degrees, thereby placing the queens in front of the kings. It should be appreciated that the board could be oriented wherein the kings are either starting in black or white squares, as the overall function does not make a difference. Further, in the preferred embodiment, the bishop pieces begin on the same color squares, as opposed to conventional standard chess, wherein the bishops are on opposite colored squares.

In FIG. 6, a top view of a pawn 601 is shown. It is contemplated that in some embodiments, the pawn 601 can include one or more directional elements 603 which provide a visual indication of a direction that the pawn is allowed to travel. The indicator can be any feature, such as a fin, slash, arrow, LED, or any other feature that designates the direction of the pawn's movement. Again, as the pawn begins movement in a desired direction, the pawn is locked into that direction.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A method of playing a chess game, comprising the steps of:

providing a standard chess board having a plurality of squares of alternating colors and having a north direction and an east direction corresponding to first and second sides of the standard chess board, the sides extending from a first corner of the standard chess board;

providing a first set of chess pieces of a first color and a second set of chess pieces of a second color, wherein the first set and second sets of chess pieces each include a king, a queen, two rooks, two bishops, two knights, and eight pawns;

initially arranging the first set of chess pieces in a first corner of the standard chess board, wherein the arranging the first set of chess further comprises:

placing the king of the first set of chess pieces in an A1 position;

placing the queen of the first set of chess pieces in a B2 position;

placing a first bishop of the first set of chess pieces in an A2 position;

placing a second bishop of the first set of chess pieces in a B1 position;

placing a first knight of the first set of chess pieces in an A3 position;

placing a second knight of the first set of chess pieces in a C1 position;

placing a first rook of the first set of chess pieces in an A4 position;

placing a second rook of the first set of chess pieces in a D1 position;

placing a first pawn of the first set of chess pieces in an A5 position;

placing a second pawn of the first set of chess pieces in a B4 position;

placing a third pawn of the first set of chess pieces in a B3 position;

placing a fourth pawn of the first set of chess pieces in a C3 position;

placing a fifth pawn of the first set of chess pieces in a C2 position;

placing a sixth pawn of the first set of chess pieces in a D2 position;

placing a seventh pawn of the first set of chess pieces in an E1 position; and placing an eighth pawn of the first set of chess pieces in a D4 position;

initially arranging the second set of chess pieces in the second corner of the standard chess board wherein the second corner is directly diagonally opposite to the first corner and arranging the second set of chess pieces in the second corner of the standard chess pieces further comprises:

placing the king of the second set of chess pieces in an H8 position;

placing the queen of the second set of chess pieces in a G7 position;

placing a first bishop of the second set of chess pieces in an H7 position;

placing a second bishop of the second set of chess pieces in a G8 position;

placing a first knight of the second set of chess pieces in an F8 position;

placing a second knight of the second set of chess pieces in a H6 position;

placing a first rook of the second set of chess pieces in an H5 position;

placing a second rook of the second set of chess pieces in a E8 position;

placing a first pawn of the second set of chess pieces in an H4 position;

placing a second pawn of the second set of chess pieces in a G5 position;

placing a third pawn of the second set of chess pieces in a G6 position;

placing a fourth pawn of the second set of chess pieces in a F6 position;

placing a fifth pawn of the second set of chess pieces in a F7 position;

placing a sixth pawn of the second set of chess pieces in a E5 position;

placing a seventh pawn of the second set of chess pieces in an E7 position; and placing an eighth pawn of the second set of chess pieces in a D8 position;

wherein each of the pawns is movable in an initial move at least at some times one or two spaces only in north or east directions except for purposes of capture in which case the pawn is movable forward or sideways diagonally one space and wherein the pawns are each movable in subsequent moves at least at some times in one space only in the north or east directions except for purposes of capture in which case the pawns are each movable forward or sideways diagonally one space; and moving each pawn only in a locked direction of either north or east throughout the game in accordance with each particular pawn's initial move direction;

providing each pawn with a first directional indicator indicating a north direction, and a second directional indicator indicating an east direction; and wherein one of the first directional indicator and second directional indicator for each pawn provides a visual indication reminder of which locked direction each particular pawn must travel throughout the game.

2. The method of claim 1, further comprising:

playing an altered game of chess by alternating moves between the first set of chess pieces and the second set of chess pieces.

3. The method of claim 1, wherein the directional indicator is an LED.

* * * * *